United States Patent [19]

Iiyama et al.

[11] 4,056,824

[45] Nov. 1, 1977

[54] DEVELOPING APPARATUS FOR DIAZO COPYING MACHINE

[75] Inventors: Kiyotaka Iiyama; Takeshi Matsui, both of Yokohama; Shigeru Kusakata, Kawasaki; Michihisa Takahashi, Tachikawa, all of Japan

[73] Assignee: Ricoh Company, Ltd., Tokyo, Japan

[21] Appl. No.: 719,864

[22] Filed: Sept. 1, 1976

[30] Foreign Application Priority Data

| | | |
|---|---|---|
| Sept. 3, 1975 | Japan | 50-106799 |
| Sept. 4, 1975 | Japan | 50-107402 |

[51] Int. Cl.[2] ..... G03D 7/00

[52] U.S. Cl. ..... 354/300; 354/299

[58] Field of Search ..... 354/300, 299, 297, 319

[56] References Cited

U.S. PATENT DOCUMENTS

| | | | |
|---|---|---|---|
| 3,280,717 | 10/1966 | Bungay | 354/300 X |
| 3,613,547 | 10/1971 | Snarr et al. | 354/324 X |
| 3,776,117 | 12/1973 | Kobayashi | 354/300 X |
| 3,832,730 | 8/1974 | Geyken et al. | 354/299 |
| 3,943,538 | 3/1976 | Hilgers et al. | 354/299 |

*Primary Examiner*—R. L. Moses

*Attorney, Agent, or Firm*—Frank J. Jordan

[57] ABSTRACT

A developing chamber and inlet and outlet chambers leading to and from the developing chamber respectively are uniformly heated in such a manner that ammonia gas used as a developing agent and water vapor are prevented from being condensed and contaminating copy sheets.

15 Claims, 6 Drawing Figures

DEVELOPING APPARATUS FOR DIAZO COPYING MACHINE

BACKGROUND OF THE INVENTION

The present invention relates to a developing apparatus for a diazo copying machine.

In a diazo copying machine, a copy sheet is developed by passing the sheet through a developing chamber filled with ammonia vapor. A heater, for example comprising three to five sheathed heating elements, are provided in the developing chamber to maintain the ammonia in vapor form. Typically, an inlet chamber and an outlet chamber are provided adjoining the developing chamber which are separated from the developing chamber by sheet feed rollers. A problem has heretofore remained in such developing apparatus in that when the copying machine is initially energized, the temperature distribution in the developing chamber is uneven and the temperature is lower at the ends than in the center thereof. As a result, the temperature in the developing chamber near the feed rollers separating the developing chamber from the inlet chamber is often too low to prevent condensation of water vapor contained in the developing chamber. In addition, since the inlet chamber is indirectly heated, the temperature therein is similarly too low to prevent condensation of water vapor. Water vapor thereby condenses on the feed roller and is transferred to copy sheets as they are fed by the feed rollers from the inlet chamber into the developing chamber. This condensed water severely degrades the developing process such that extremely blurred copies are produced.

SUMMARY OF THE INVENTION

It is an object of the present invention to provide a developing apparatus for a diazo copying machine which eliminates the problem of vapor condensation resulting in blurred copies.

It is another object of the present invention to provide a developing apparatus for a diazo copying machine comprising novel heating means which maintain the temperature in developing chamber and an inlet chamber uniformly high enough to prevent vapor condensation therein.

It is another object of the present invention to provide a developing apparatus for a diazo copying machine in which rollers which deed copy sheets into a developing chamber are heated to prevent vapor condensation thereon.

It is another object of the present invention to provide a developing apparatus for a diazo copying machine in which upper and lower plates of a developing chamber constitute heaters.

It is another object of the present invention to provide a developing apparatus for a diazo copying machine in which a guide plate provided in a developing chamber constitutes a heater.

It is another object of the present invention to provide a generally improved developing apparatus for a diazo copying machine.

Other objects, together with the foregoing, are attained in the embodiments described in the following description and illustrated in the accompanying drawings.

DESCRIPTION OF THE PREFERRED EMBODIMENTS

While the developing apparatus for a diazo copying machine of the invention is susceptible of numerous physical embodiments, depending upon the environment and requirements of use, substantial numbers of and herein shown and described embodiments have been made, tested and used, and all have performed in an eminently satisfactory manner.

Figure 1:
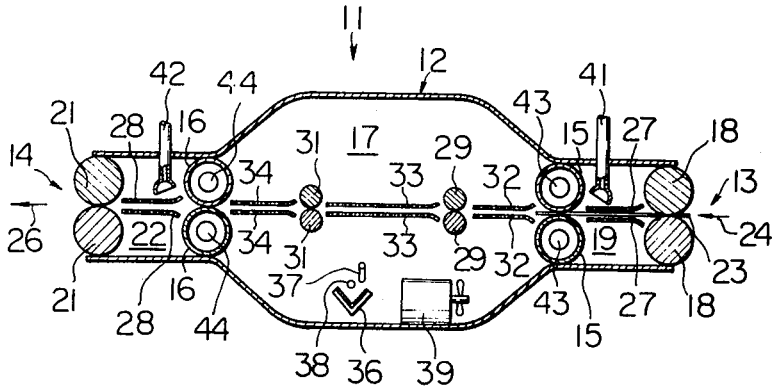
FIG. 1 is a plan view of a first embodiment of a developing apparatus for a diazo copying machine according to the present invention.

Referring now to FIG. 1, a first embodiment of a developing apparatus for a diazo copying machine according to the present invention is generally designated as 11 and comprises a housing 12 formed with an inlet opening 13 and an outlet opening 14. A pair of inner inlet feed rollers 15 and a pair of inner outlet feed rollers 16 are provided in the housing 12 and define therebetween a developing chamber 17. The rollers 15 and 16 sealingly engage with each other and with the inner walls of the housing 12 to sealingly enclose the developing chamber 17. A pair of outer inlet feed rollers 18 are disposed at the inlet opening 13 and sealingly engage with each other and with the inner walls of the housing 12 to define an inlet chamber 19 between the rollers 15 and 18. In a similar manner, a pair of outer outlet feed rollers 21 sealingly define an outlet chamber 22 in conjunction with the rollers 16.

The rollers 15, 16, 18 and 21 are all driven by drive means (not shown) to feed a copy sheet 23 through the housing 12 from the inlet opening 13 to the outlet opening 14 as indicated by arrows 24 and 26. To guide the passage of the sheet 23 through the housing 12, cooperating pairs of guide plates 27 and 28 are provided in the inlet and outlet chambers 19 and 22 respectively. In addition, two pairs of guide rollers 29 and 31 are drivingly provided in the developing chamber 17 alternately between pairs of guide plates 32, 33 and 34 which are formed with a large number of perforations to allow vapor in the developing chamber 17 to reach the sheet 23 as will be described below.

In the diazo process to which the present invention relates, the copy sheet 23 is prepared in such a manner that after exposure to a light image, the sheet 23 is developed to form a visible and permanent image by exposure to ammonia vapor. To this end, a tray 36 is provided in the lower portion of the developing chamber 17 and a tube 37 leads from a source of liquid ammonia (not shown) into the tray 36.

A heater 38 is provided to heat the tray 36 and thereby vaporize the ammonia. A circulating fan 39 circulates the ammonia vapor through the interior of the developing chamber 17.

In operation, the sheet 23 is fed by means of the feed rollers 18, 15, 16 and 21 between the guide plates 27, 32, 33, 34 and 28 from the inlet opening 13 through the housing 12 to the outlet opening 14. During passage through the developing chamber 17, the sheet 23 is developed by exposure to the ammonia vapor. As the sheet 23 passes between the feed rollers 15, a small amount of ammonia vapor escapes from the developing chamber 17 into the inlet chamber 19 between the end portions of the feed rollers 15. A discharge tube 41 leads from the inlet chamber 19 to conduct away this vapor. Preferably, the tube 41 communicates with a pump to forcibly remove the ammonia vapor from the inlet chamber 19 and a reduction unit containing a catalyst to catalytically decompose the ammonia vapor. In a similar manner, a discharge tube 42 leads from the outlet chamber 22.

A problem exists in the developing apparatus 11 as described thus far in that when the apparatus 11 is initially energized and the heater 38 is first activated, the circulating fan 39 is not sufficient to establish a uniform temperature distribution in the developing chamber 17 immediately such that the temperature in all portions of the developing chamber 17 is high enough to prevent condensation of the ammonia vapor and any water vapor present in the developing chamber 17. Particularly, the temperature remains low for a substantial amount of time in the vicinity of the inner feed rollers 15 and 16. In addition, since the inlet and outlet chambers 19 and 22 are not heated directly, the temperature therein will remain low for a considerable period of time. The detrimental effect caused by this phenomenon is that water vapor in the developing chamber 17 and inlet chamber 19 will condense on the rollers 15 and be transferred to the sheet 23 to degrade the developing process in the developing chamber 17. In extreme cases, water vapor may even condense directly on the sheet 23 as it passes between the rollers 15 into the developing chamber 17.

To overcome this drawback, the present invention provides the rollers 15 and 16 in a hollow, heat conducting configuration and incorporates heaters 43 and 44 therein respectively. The heaters 43 and 44 are designed to heat the rollers 15 and 16 to a temperature high enough to positively prevent condensation of ammonia and water vapor thereon which might be transferred to the sheet 23. In addition, the rollers 15 and 16, thus heated, radiate heat into the inlet and outlet chambers 19 and 22 which raise the temperature therein high enough to ensure that vapor will not condense on the walls of the housing 12 defining the inlet and outlet chambers 19 and 22 respectively. The rollers 15 and 16 furthermore radiate heat into the developing chamber 17 in the areas in which the temperature naturally tends to be lowest thereby facilitating the even distribution of heat in the developing chamber 17.

The rollers 16, heated by the heaters 44, in addition to radiating heat into the developing chamber 17 serve to heat the sheet 23 during passage therebetween to aid in the rapid evaporative discharge of ammonia therefrom.

Throughout the various embodiments of the invention shown in the respective drawings, like elements are described by the same reference numerals.

Figure 2:
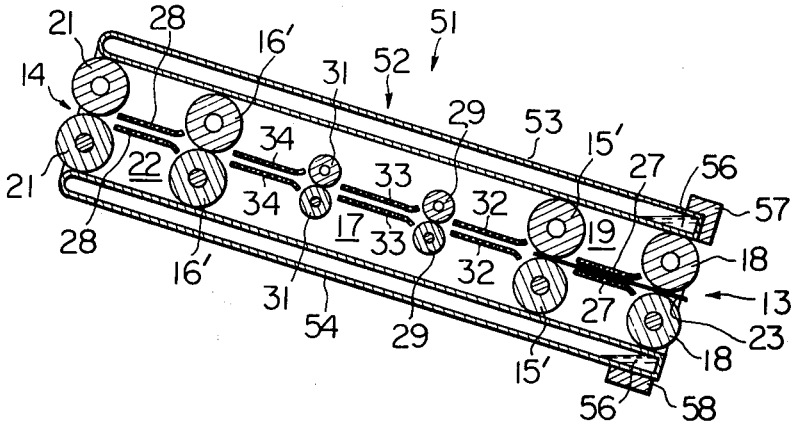
FIG. 2 is a similar to FIG. 1 but shows a second embodiment.

Referring now to FIG. 2, a second embodiment of the invention is designated as 51 and comprises a housing 52. In the apparatus 51, the rollers 15 and 16 are solid and are designated as 15' and 16' respectively. The heaters 43 and 44 are omitted.

The upper and lower walls of the housing 52 are constituted by hollow plates 53 and 54. A heat transfer fluid 56 is sealingly contained in the plates 53 and 54 and heaters 57 and 58 are fixed to the housing 52 to heat the right ends of the plates 57 and 58 respectively. In addition, the housing 52 is tilted in such a manner that the right ends of the plates 53 and 54 are in lowermost positions.

The heat transfer fluid 56 preferably has a boiling point at or slightly above 100° C. Suitable fluids for use as the heat transfer fluid 56 include water, benzene, acetone, methanol, ethanol, toluene, N-heptane, N-pentane and perchloroethylene. The fluid 56 must not have chemical properties which would corrode the inner walls of the hollow plates 53 and 54 nor react therewith in such a manner as to form an inert and noncondensible gas. The fluids enumerated above are especially suitable if the plates 53 and 54 are formed of stainless steel.

Due to the orientation of the housing 52, the fluid 56, upon condensation, accumulates in the lower right ends of the plates 53 and 54 adjacent to the heaters 57 and 58 respectively. The fluid 56 absorbs heat, vaporizes, and expands, due to the increased pressure, to fill the interiors of the plates 53 and 54. The upper leftward ends of the plates 53 and 54 are coolest since they are farthest from the heaters 57 and 58, and the fluid 56 condenses in these areas thereby giving up latent heat of vaporization to the walls of the plates 53 and 54. The temperature distribution in the plates 53 and 54 is stabilized in this manner so that the plates 53 and 54 radiate heat into the developing chamber 17 and the inlet and outlet chambers 19 and 22 to maintain the temperature therein at a uniform value which is above the condensation temperatures of ammonia and water. The operating temperature in the chambers 17, 19 and 22 is reached quickly and is maintained uniform through thermal radiation from the plates 53 and 54.

Figure 3:
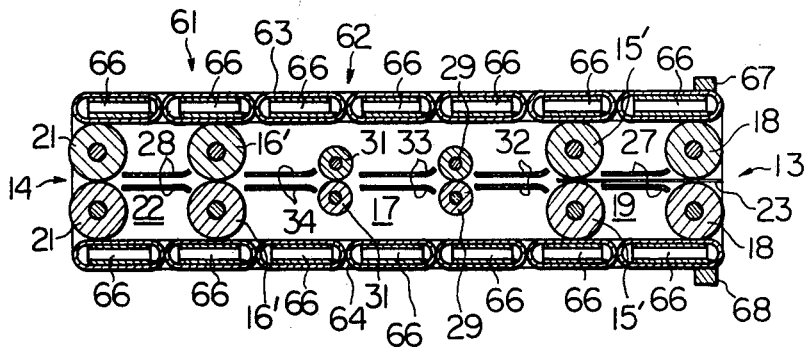
FIG. 3 similarly shows a third embodiment.

FIG. 3 shows another apparatus 61 embodying the present invention comprising a housing 62 in which the plates 53 and 54 are replaced by rows of heat pipes which are all designated as 66.

Each heat pipe 66 comprises a tubular thermally conductive shell and an inner wick and contains a heat transfer fluid in a known manner that heat applied to one end of a pipe 66 vaporizes the fluid therein which expands to fill the shell. The fluid condenses at the shell wall thereby giving off latent heat of vaporization thereto which is radiated therefrom. The condensed fluid is returned to the heated end of the shell through the wick by capillary action. This type of heat pipe 66 is characterized by the fact that the temperature is substantially uniform along the length thereof.

In the apparatus 61, the heat pipes 66 are placed end to end to constitute upper and lower plates 63 and 64. Heaters 67 and 68 are provided to heat the right ends of the rightmost heat pipes 66 of the plates 63 and 64 respectively. The pipes 66 conduct the heat from the heaters 67 and 68 leftwardly, from the left end of one heat pipe 66 to the right end of the next pipe 66, in such a manner that the plates 63 and 64 give off a uniform amount of heat along their lengths to evenly heat the chambers 17, 19 and 22 to the proper temperature to prevent vapor condensation therein. The housing 62 may be maintained horizontal or tilted as desired without affecting the temperature distribution.

Figure 4:
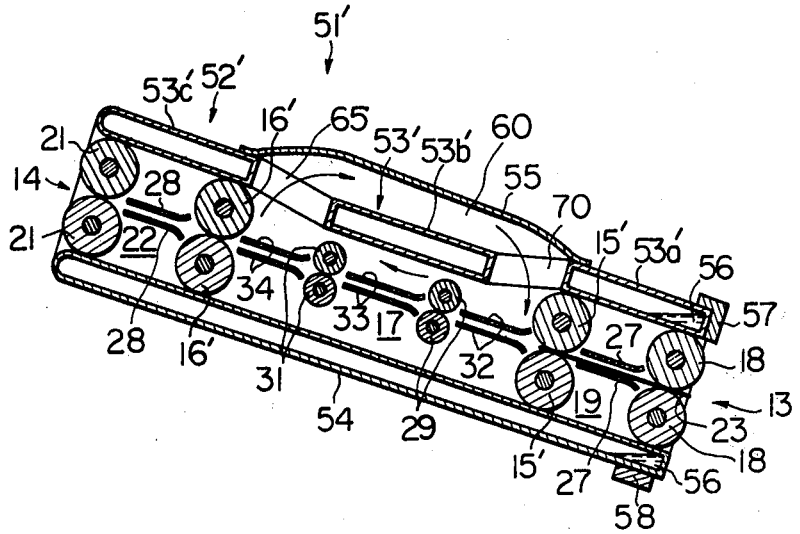
FIG. 4 similarly shows a fourth embodiment.

FIG. 4 shows an apparatus 51' which is a modification of the apparatus 51 and comprises a housing 52'. The apparatus 51' differs from the apparatus 51 in the configuration of the upper hollow plate, which is here designated as 53'.

The plate 53' is formed in three sections **53*a'*, 53*b'* and 53*c'* which communicate with each other and are hermetically sealed as is the plate 53 of the apparatus 51. The sections 53***a*', 53*b*' and 53*c*' define the inlet chamber 19, developing chamber 17 and the outlet chamber 22 in conjunction with the lower plate 54. A cover plate 55 is sealingly provided above the section 53*b*' to define therebetween a circulation chamber 60. A first circulation passageway 65 leads through the section 53*b*' adjacent to the rollers 16' thereby communicating the developing chamber 17 with the circulation chamber 60 therethrough. In a similar manner, a second circulation passageway 70 is formed through the section 53*b*' adjacent to the rollers 15'.

The passageways 65 and 70 and the circulation chamber 60 serve to promote circulation of ammonis vapor through the developing chamber 17 and thereby aid in establishing uniform temperature therein, especially in the areas near the rollers 15' and 16'. Warm ammonia vapor rises into the upper left portion of the developing chamber 17 and enters the circulation chamber 60 through the passageway 65 in which it cools and flows downwardly through the circulation chamber 60 to the lower right portion thereof. The cool vapor flows downwardly into the lower right portion of the developing chamber 17 through the passageway 70, is heated, and again rises through the developing chamber 17 to the passageway 65. This circulation of vapor is indicated in FIG. 4 by arrows.

Figure 5:
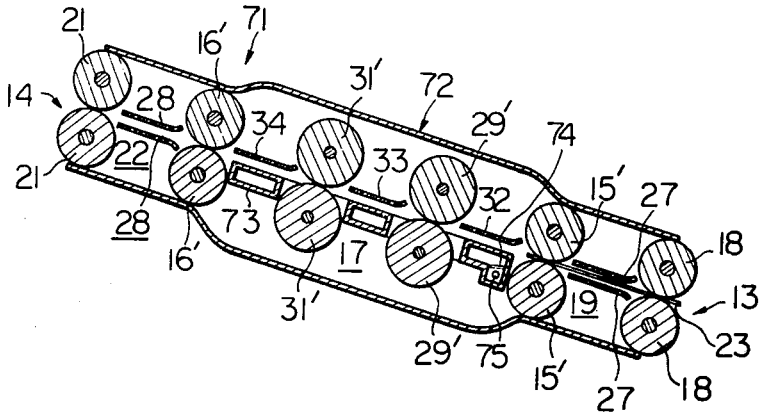
FIG. 5 similarly shows a fifth embodiment.

FIG. 5 illustrates another apparatus 71 embodying the present invention which comprises a housing 72 which is essentially similar to the housing 12.

The apparatus 71 comprises, rather than the lower guide plates 32, 33 and 34, a hollow plate 73 of the same type as the plates 53 and 54 of the apparatus 51. The plate 73 serves the dual function of guiding the sheet 23 through the developing chamber 17 and heating the chamber 17. The plate 73 is filled with a heat transfer fluid 74 which is heated by an immersion heater 75 provided inside the plate 73 at the right end thereof. The housing 72 is tilted so that condensed fluid 74 flows downwardly to the right end of the plate 73.

Figure 6:
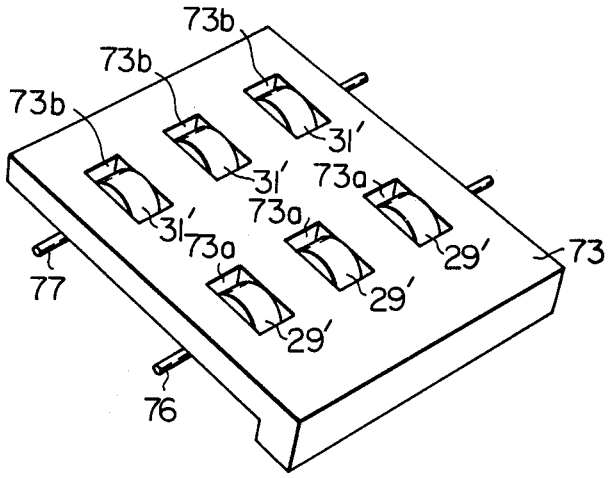
FIG. 6 is a perspective view of a heater and guide plate assembly of the embodiment of FIG. 5.

Referring also to FIG. 6, the plate 73 is formed with openings 73*a* and 73*b.* Shafts 76 and 77 are driven for rotation by drive means (not shown) so that lower guide rollers 29' and 31' fixed thereto cooperate with upper guide rollers which are similarly designated to feed the sheet 23 through the developing chamber 17. The rollers 29' and 31' are of larger diameter than the corresponding guide rollers 29 and 31 of the apparatus 11 and protrude through the openings 73*a* and 73*b* respectively.

The means for introducing ammonia vapor into the developing chamber 17 are not shown in FIGS. 2 to 5 for simplicity of illustration. Said means may comprise an arrangement identical to that shown in FIG. 1. Alternatively, ammonia vapor may be generated external of the apparatus and piped into the developing chamber 17. In a similar manner, the fan 39 may be located external of the apparatus and connected thereto by a duct. Whereas in the apparatus 11 all of the rollers 15 and 16 are shown as being heated, only one roller of each pair may be heated or only one or both of the rollers 15 may be heated. Many other modifications within the scope of the invention will become possible for those skilled in the art after receiving the teachings of the present disclosure.

What is claimed is:

1. In a diazo copying machine, a developing apparatus comprising:

a housing formed with an inlet opening and an outlet opening;

a pair of inner inlet feed rollers and a pair of inner outlet feed rollers operatively disposed in the housing in substantially sealing cooperation to define therebetween a developing chamber within the housing;

a pair of outer inlet feed rollers provided within the housing adjacent to the inlet opening in substantially sealing cooperation to define with the inner inlet feed rollers an inlet chamber therebetween;

a pair of outer outlet feed rollers provided within the housing adjacent to the outlet opening in substantially sealing cooperation to define with the inner outlet feed rollers an outlet chamber therebetween;

means for introducing a vaporized developing fluid into the developing chamber; and heating means provided in the housing to maintain the developing chamber and inlet and outlet chamber at temperature high enough to prevent condensation of the developing fluid and water vapor therein.

2. An apparatus an in claim 1, in which the heating means comprises means for heating one of the pair of inner inlet feed rollers.

3. An apparatus as in claim 2, in which said one inner inlet feed roller is hollow, said means comprising a heater disposed inside said inner inlet feed roller.

4. An apparatus as in claim 3, in which the heating means further comprises a heater disposed in the developing chamber.

5. An apparatus as in claim 1, in which one of the inner outlet feed rollers is hollow, the heating means comprising a heater disposed inside said one inner outlet feed roller.

6. An apparatus as in claim 1, in which the heating means comprises a hollow plate disposed substantially coextensively in the developing chamber, a heat transfer fluid contained in the hollow plate, a heater disposed to heat one end of the hollow plate and vaporize the heat transfer fluid therein at said end and means to return condensed heat transfer fluid to said end.

7. An apparatus as in claim 6, in which the heat transfer fluid is selected from the group consisting of water, benzene, acetone, methanol, ethanol, toluene, N-heptan, N-pentane and perchloroethylene.

8. An apparatus as in claim 6, in which the plate is inclined so that said end is disposed in a lowermost position.

9. An apparatus as in claim 6, in which the hollow plate constitutes an outer shell of a heat pipe, said means comprising a wick provided in the outer shell.

10. An apparatus as in claim 6, further comprising sheet guide means provided in the developing chamber.

11. An apparatus as in claim 10, in which the sheet guide means comprises the hollow plate.

12. An apparatus as in claim 11, in which the hollow plate is formed with openings therethrough, the sheet guide means further comprising rollers protruding upwardly through the openings respectively.

13. An apparatus as in claim 6, in which the hollow plate constitutes an upper wall of the housing defining the developing chamber, the heating means further comprising a second hollow plate disposed substantially coextensively in the developing chamber and constituting a lower wall of the housing defining the developing chamber, a heat transfer fluid contained in the second hollow plate, a heater disposed to heat one end of the second hollow plate and vaporize the heat transfer fluid therein at said one end and means to return condensed heat transfer fluid to said one end.

14. An apparatus as in claim 13, in which said hollow plate and said second hollow plate further constitute upper and lower walls respectively defining the inlet and outlet chambers.

15. An apparatus as in claim 8, in which the hollow plate constitutes an upper wall of the developing chamber, the apparatus further comprising a cover provided above the hollow plate to sealingly define a circulation chamber therebetween, a first circulation passageway leading from the developing chamber adjacent to the inner outlet feed rollers into the circulation chamber and a second circulation passagewy leading from the circulation chamber into the developing chamber adjacent to the inner inlet rollers.

* * * * *